US010758756B2

(12) United States Patent
Marlin et al.

(10) Patent No.: US 10,758,756 B2
(45) Date of Patent: Sep. 1, 2020

(54) FIRE EXTINGUISHER

(71) Applicant: ARIANEGROUP SAS, Paris (FR)

(72) Inventors: Frederic Marlin, Saint Medard (FR); Raphael Teoldi, Saucats (FR)

(73) Assignee: ARIANEGROUP SAS, Paris (FR)

( * ) Notice: Subject to any disclaimer, the term of this patent is extended or adjusted under 35 U.S.C. 154(b) by 43 days.

(21) Appl. No.: 15/740,433

(22) PCT Filed: Jun. 20, 2016

(86) PCT No.: PCT/FR2016/051495
§ 371 (c)(1),
(2) Date: Dec. 28, 2017

(87) PCT Pub. No.: WO2017/001743
PCT Pub. Date: Jan. 5, 2017

(65) Prior Publication Data

US 2018/0185681 A1 Jul. 5, 2018

(30) Foreign Application Priority Data

Jun. 29, 2015 (FR) ..... 15 56030

(51) Int. Cl.
*A62C 13/22* (2006.01)
*A62C 3/07* (2006.01)
*A62C 35/02* (2006.01)

(52) U.S. Cl.
CPC ..... *A62C 13/22* (2013.01); *A62C 3/07* (2013.01); *A62C 35/023* (2013.01)

(58) Field of Classification Search
CPC ..... A62C 3/07; A62C 35/023; A62C 13/22
See application file for complete search history.

(56) References Cited

U.S. PATENT DOCUMENTS 1,648,397 A * 11/1927 Hermann ..... A62C 13/22 169/26
2,786,536 A * 3/1957 Orsini ..... A62C 13/22 169/6

(Continued)

FOREIGN PATENT DOCUMENTS

DE 20 2006 002 892 U1 5/2006
RU 2 078 599 C1 5/1997

(Continued)

*Primary Examiner* — Darren W Gorman
*Assistant Examiner* — Steven M Cernoch
(74) *Attorney, Agent, or Firm* — Oblon, McClelland, Maier & Neustadt, L.L.P.

(57) ABSTRACT

A fire extinguisher including a body extending along a longitudinal axis and defining a storage chamber wherein a load of an extinguishing agent is present, and also a pressurizing chamber including a pyrotechnic gas generator, the pressurizing chamber being separated from the storage chamber by a perforated wall configured to put an outlet of the pyrotechnic gas generator into communication with the storage chamber, the perforated wall defining an end of the storage chamber, the extinguisher having a discharge channel configured to deliver the extinguishing agent to the outside of the extinguisher during actuation of the pyrotechnic gas generator, the discharge channel opening out into the storage chamber through an opening positioned at a distance from the perforated wall, as measured along the longitudinal axis of the body, that is less than or equal to half the length of the storage chamber.

15 Claims, 3 Drawing Sheets

(56) References Cited

U.S. PATENT DOCUMENTS

| | | | | |
|---|---|---|---|---|
| 5,305,957 | A * | 4/1994 | Szocs | B01F 3/06 239/302 |
| 5,660,236 | A * | 8/1997 | Sears | A62C 13/22 169/33 |
| 7,337,856 | B2 * | 3/2008 | Lund | A62C 99/0018 169/6 |
| 8,100,670 | B2 * | 1/2012 | Bodart | A62C 13/22 417/158 |
| 2013/0175058 | A1 * | 7/2013 | Williams | A62C 35/08 169/46 |

FOREIGN PATENT DOCUMENTS

| | | | |
|---|---|---|---|
| RU | 2 085 235 | C1 | 7/1997 |
| WO | 98/02211 | A1 | 1/1998 |
| WO | 2004/091729 | A1 | 10/2004 |

* cited by examiner

FIRE EXTINGUISHER

BACKGROUND OF THE INVENTION

The invention relates to a fire extinguisher including a pyrotechnic gas generator.

A fire extinguisher is conventionally in the form of a tank containing an extinguishing agent that is to be delivered onto the zone of a fire in order to extinguish it. Several types of extinguisher are known in the state of the art.

In particular, extinguishers are known that are permanently pressurized, comprising a tank under gas pressure containing the extinguishing agent, or else a gas cylinder under pressure in communication with the chamber in which the extinguishing agent is present. In that type of extinguisher, the extinguishing agent or the propellant gas for propelling the extinguishing agent is stored permanently under pressure. In order to use extinguishers having a pressurized gas cylinder, the gas cylinder is initially actuated by the user in order to release the pressurizing gas into the chamber containing the extinguishing agent, and then the extinguishing agent as put under pressure in this way is delivered onto the fire zone by manual actuation.

Extinguishers that are permanently pressurized present certain drawbacks, such as in particular the need for a certain number of monitoring and verification operations (periodic weighing). In addition, since the pressure of gas varies with temperature, the operation of extinguishers of that type is temperature-sensitive.

Another drawback is that while delivering the extinguishing agent, the volume available for the gas increases and thus the pressure of the gas decreases, thereby reducing the rate at which the extinguishing agent is delivered, and consequently reducing the effectiveness of the extinguisher. In an attempt to mitigate that drawback, it is possible to increase the pressure available at the beginning of delivering the extinguishing agent, however for safety reasons such a solution makes it necessary to overdimension the extinguisher, and consequently to increase its overall size and also its cost price.

As an alternative to extinguishers that are permanently pressurized, a second type of extinguisher has been proposed that includes a pyrotechnic gas generator. The pyrotechnic gas generator enables combustion gas to be produced that serves to pressurize the chamber in which the extinguishing agent is present, and consequently to deliver said extinguishing agent onto the fire zone. Such extinguishers with a pyrotechnic gas generator give relatively high performance and serve to mitigate some of the drawbacks of extinguishers with permanent pressurization.

In particular, Document DE 20 2006 002 892 discloses an extinguisher having a pyrotechnic gas generator presenting architecture that is relatively close to the architecture of permanently pressurized extinguishers that make use of a cylinder of gas under pressure. In that document, the gas generator is actuated by a manual striker situated at one end of the tank and it communicates with the load of extinguishing agent via a first dip tube. A second dip tube is connected to the outlet orifice and serves to direct the extinguishing agent towards the outlet orifice. A lance having a trigger communicates with the outlet orifice and enables the extinguishing agent to be delivered into the outside medium after actuation by a user.

The extinguisher of Document DE 20 2006 002 892 presents certain advantages, but nevertheless it would still be desirable to be able to simplify its structure, in particular in order to reduce the cost of fabricating such an extinguisher. Furthermore, the rate at which the extinguishing agent is delivered is not always optimal in that type of extinguisher.

There thus exists a need to have fire extinguishers available that present a structure that is simplified and a fabrication cost that is reduced.

There also exists a need to have fire extinguishers available that present an optimized flow rate for delivering the extinguishing agent.

OBJECT AND SUMMARY OF THE INVENTION

To this end, in a first aspect, the invention provides a fire extinguisher comprising a body extending along a longitudinal axis and defining a storage chamber in which a load of an extinguishing agent is present, and also a pressurizing chamber comprising a pyrotechnic gas generator, the pressurizing chamber being separated from the storage chamber by a perforated wall configured to put an outlet of the pyrotechnic gas generator into communication with the storage chamber, the perforated wall defining an end of the storage chamber, the extinguisher having a discharge channel configured to deliver the extinguishing agent to the outside of the extinguisher during actuation of the pyrotechnic gas generator, said discharge channel opening out into the storage chamber through an opening positioned at a distance from the perforated wall, as measured along the longitudinal axis of the body, that is less than or equal to half the length of the storage chamber.

The pyrotechnic gas generator is configured to produce a combustion gas that flows into the storage chamber through the outlet of said gas generator and the perforated wall so as to put the storage chamber under pressure. The discharge channel is configured to enable the extinguishing agent to be delivered into the medium outside the extinguisher as a result of the storage chamber being put under pressure by the combustion gas.

The extinguisher of the present invention presents a particular arrangement in which firstly there is separation between the compartment containing the gas generator and the compartment containing the extinguishing agent, and secondly the discharge channel is positioned in a manner that is relatively close to the end of the storage chamber. The inventors have observed that this particular arrangement serves advantageously to provide a high-performance extinguisher that enables the majority or even substantially all of the weight of the load of extinguishing agent to be delivered, while presenting a structure that is simplified in which the use of dip tubes in the storage chamber is made superfluous. As a result, the invention provides an effective fire extinguisher presenting a fabrication cost that is significantly smaller, in particular compared with the extinguishers described in DE 20 2006 002 892.

In an embodiment, the extinguisher may also further comprise a first shutter shutting the discharge channel in sealed manner, said first shutter being configured to enable the extinguishing agent to exit to the outside of the extinguisher through the discharge channel when the pressure in the storage chamber exceeds a predefined value.

As mentioned above, the rate at which the extinguishing agent is delivered is not always optimum when using an extinguisher of the kind taught in Document DE 20 2006 002 892. The inventors have observed that the problem that can be encountered by an extinguisher of that type making use of manual actuation is that, at the moment when the user actuates opening of the outlet orifice, the pressure inside the tank can have reduced significantly. Specifically, the gas generated by the pyrotechnic gas generator is hot and the tank pressurizing effect is thus more temporary as a result of the gas cooling than is the pressurizing effect obtained when using a gas cartridge that delivers cold gas. It is therefore advantageous not to delay expelling the extinguishing agent as a result of actuation being manual, as can happen in the architecture of Document DE 20 2006 002 892. Thus, the above configuration using a first shutter serves advantageously to optimize the rate at which the extinguishing agent is delivered by the extinguisher since, as soon as a predetermined pressure threshold is reached in the storage chamber, the first shutter acts automatically (i.e. without requiring any actuation by a user) to allow the extinguishing agent to be delivered to the outside of the extinguisher. Such a configuration serves advantageously to make best use of the extra pressure generated by the gas generator in order to deliver the extinguishing agent and it avoids the problem of user actuation that might take place at an instant when the extra pressure in the tank has already decreased significantly. Such a configuration thus makes it possible advantageously to make best use of the advantages procured by a pyrotechnic gas generator compared with a gas cartridge, which advantages are associated with the capacity to generate gas with a suitable time profile for its flow rate, unlike a gas cartridge generating a flow rate profile that decreases drastically.

In an embodiment, the perforated wall may include at least one perforation and the extinguisher may also include a second shutter shutting said at least one perforation in sealed manner, said second shutter being configured to act, under the effect of the pressure of a combustion gas produced by the gas generator, to enable said gas to flow into the storage chamber through said at least one perforation.

The presence of the second shutter is advantageous in order to isolate and protect the gas generator, so as to prevent said gas generator being polluted by the extinguishing agent.

In an embodiment, the opening may be situated in a side wall of the body.

In an embodiment, the distance between the opening and the perforated wall may be less than or equal to one-fourth of the length of the storage chamber.

Such a configuration serves advantageously to further increase the fraction of the load of extinguishing agent that can be delivered by the extinguisher in operation.

In an embodiment, the distance between the opening and the perforated wall may be less than or equal to the inside diameter of the storage chamber.

The diameter of the storage chamber corresponds to the greatest transverse dimension of the storage chamber.

Such a configuration serves advantageously to further increase the fraction of the load of extinguishing agent that can be delivered by the extinguisher in operation.

In a variant, the discharge channel may pass through the pressurizing chamber and the opening may be situated in the perforated wall. Thus, in an embodiment of the invention, the opening may be positioned at zero distance from the perforated wall.

Such a configuration serves advantageously to provide an extinguisher capable of delivering a particularly high fraction of the load of extinguishing agent.

In particular, the pressurizing chamber may be situated between the perforated wall and an end wall of the body, the discharge channel also passing through the end wall. In a variant, the discharge channel passes through the perforated wall, the pressurizing chamber, and the side wall of the body level with the pressurizing chamber.

In an embodiment, the ratio [length of the storage chamber]/[inside diameter of the storage chamber] may be less than or equal to 10.

Such a configuration serves advantageously to further increase the fraction of the load of extinguishing agent that can be delivered by the extinguisher in operation.

In an embodiment, the perforated wall may present a plurality of perforations distributed around the longitudinal axis of the extinguisher.

In an embodiment, the extinguishing agent may be in powder form. In a variant, the extinguishing agent may be in some other form, e.g. in the form of a foam.

In an embodiment, the gas generator may include at least one housing containing a pyrotechnic charge, said pyrotechnic charge presenting a through channel.

The presence of such a through channel in the pyrotechnic charge serves advantageously to control the rate at which gas is generated during combustion of said charge, and possibly even to make that rate constant.

In an embodiment, the gas generator may include a plurality of housings, each containing a pyrotechnic charge, said housings being positioned around the longitudinal axis of the body. In addition, the housings may be positioned around an igniter device configured to ignite the pyrotechnic charges present in said housings.

Such configurations serve advantageously to provide a gas generator of structure that is relatively compact.

The present invention also provides a vehicle fitted with an extinguisher as described above.

In particular, the vehicle may be a bus. In an embodiment, the extinguisher may be incorporated in a vehicle so as to enable a fire to be extinguished in the engine of said vehicle.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF EMBODIMENTS

Figure 1:
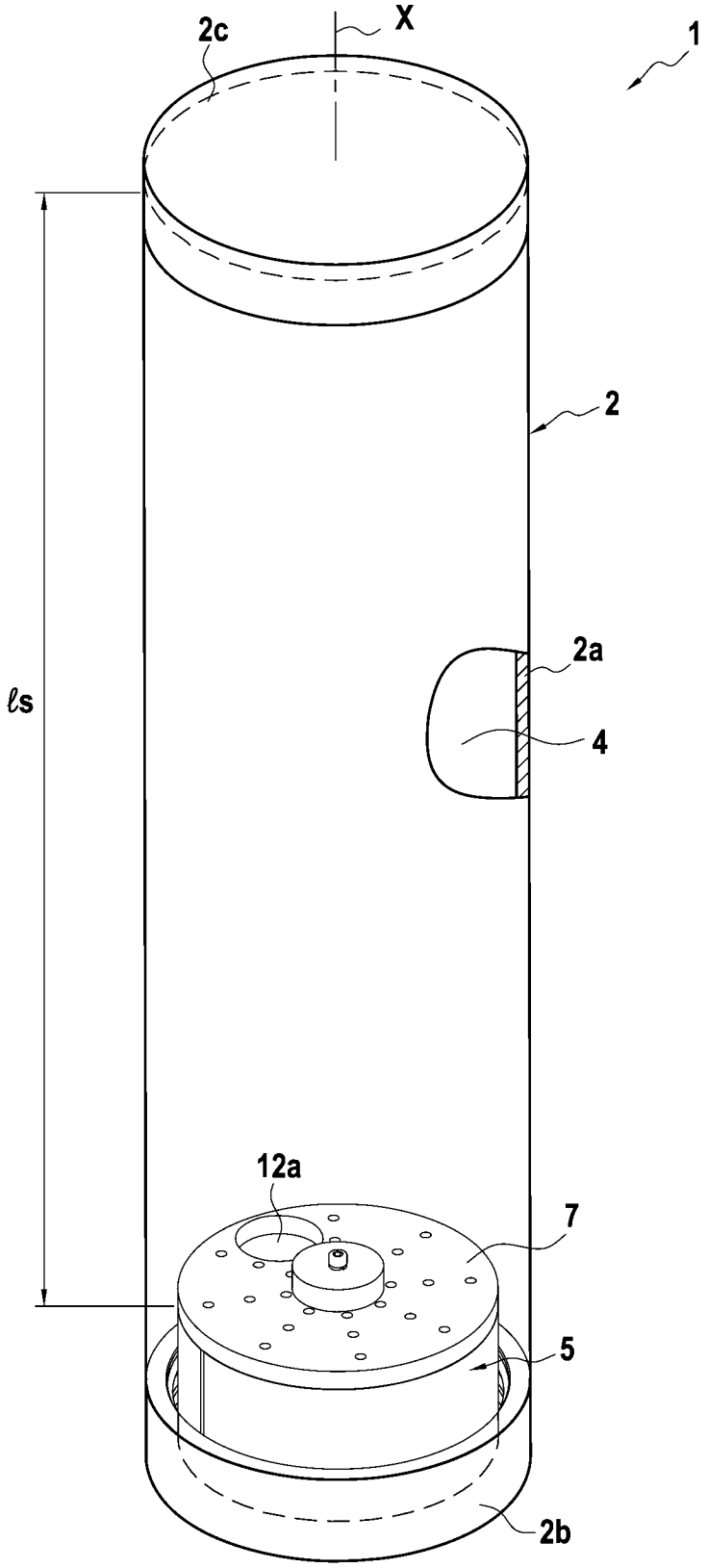
FIG. 1 shows an example extinguisher of the invention.

FIG. 1 shows an example fire extinguisher 1 of the invention. The extinguisher comprises a body 2 extending along a longitudinal axis X and defining a storage chamber 4 in which a load (not shown) of an extinguishing agent is present. In the example shown, the extinguishing agent is in the form of a powder, which powder may for example be any powder that is known for being useful in extinguishing fires of classes A, B, or C. As mentioned above, the invention covers using an extinguishing agent in other forms, such as a foam. It is advantageous for the extinguishing agent to be in the form of a powder that is not compacted, as described in detail below. The body 2 also defines a pressurizing chamber 5 containing a pyrotechnic gas generator. The pressurizing chamber 5 is separated from the storage chamber 4 by a perforated wall 7 that is configured to put an outlet of the pyrotechnic gas generator into communication with the storage chamber 4. In the example shown, the body 2 presents the shape of a body of revolution, specifically a cylinder. Naturally, the invention is not limited to such shapes for the body 2. The body 2 comprises a side wall 2*a* extending along the longitudinal axis X of the body 2 and surrounding the storage chamber 4. The side wall 2*a* of the body also surrounds the pressurizing chamber 5. The body 2 also includes a bottom end wall 2*b* and a top end wall 2*c*. The bottom end wall 2*b* and the top end wall 2*c* define the body 2 longitudinally. The pressurizing chamber 5 is situated between the perforated wall 7 and the bottom end wall 2*b* of the body 2. The storage chamber 4 is situated between the top end wall 2*c* of the body 2 and the perforated wall 7, which wall defines a bottom of the storage chamber 4. In order to improve the quantity of extinguishing agent delivered by the extinguisher by enhancing the creation of a fluidized bed during actuation of the pyrotechnic gas generator, the ratio $l_s$/D, where D is the inside diameter of the storage chamber 4 and $l_s$ is the length of the storage chamber measured along the longitudinal axis X, may advantageously be less than or equal to 10, e.g. less than or equal to 6, e.g. less than or equal to 5. This ratio $l_s$/D may be greater than or equal to 3. The length $l_s$ of the storage chamber 4 may lie in the range 45 centimeters (cm) to 90 cm, for example. The inside diameter D of the storage chamber 4 may, for example, lie in the range 10 cm to 20 cm, e.g. it may be substantially equal to 15 cm.

Figure 2:
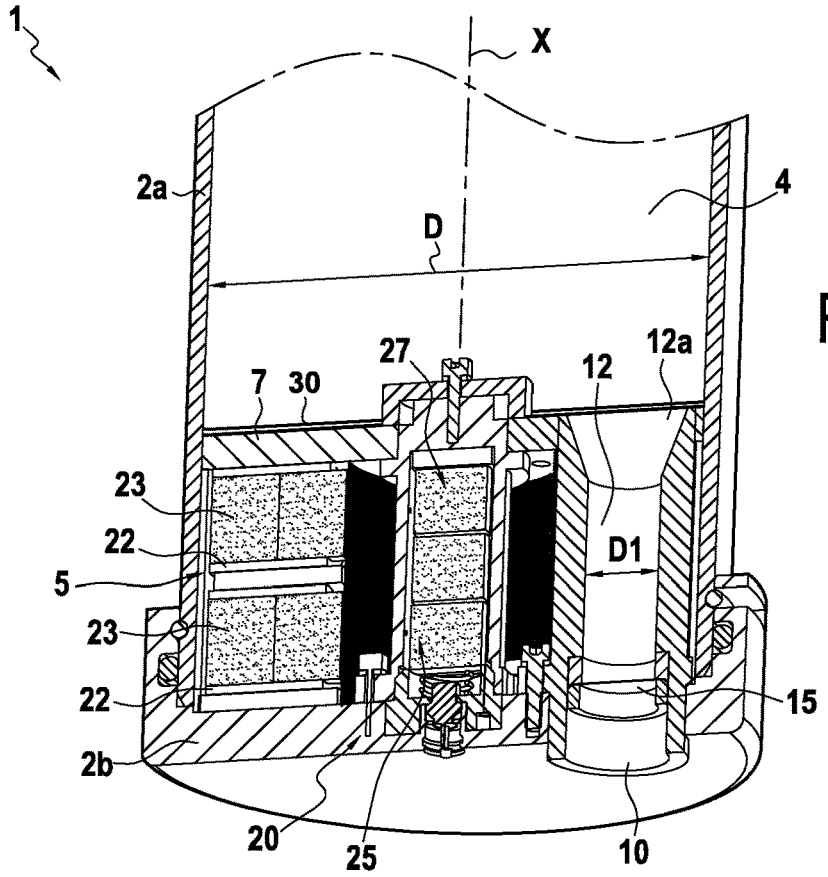
FIG. 2 is a fragmentary longitudinal section of the FIG. 1 extinguisher.

FIG. 2 is a fragmentary section on the longitudinal axis X of the FIG. 1 extinguisher 1. FIG. 2 shows in greater detail the arrangement of the pressurizing chamber 5. As shown, the pressurizing chamber 5 contains a pyrotechnic gas generator 20 that is configured to produce a combustion gas in order to pressurize the storage chamber 4. In the example shown, the gas generator 20 has a plurality of housings 22, each of these housings 22 including a pyrotechnic charge 23. The gas generator 20 also includes an igniter device 25 configured to ignite the pyrotechnic charges 23 present in the housings 22. The gas generator 20 may be triggered electrically by applying an electric current to the terminals of the initiator (as shown in FIG. 2) or it may be triggered mechanically (triggering by percussion). With mechanical triggering, a striker strikes the igniter device. Under all circumstances, initiating the ignition device 25 leads to combustion of the central charge 27, which in the example shown is in the form of stacked blocks, thereby leading to combustion of the pyrotechnic charges 23 and to release of the gas resulting from the combustion. It would not go beyond the ambit of the present invention for the gas generator 20 to have a single housing fitted with its pyrotechnic charge.

The pyrotechnic charges 23 may be in the form of monolithic blocks, possibly possessing at least one open channel, as described in detail below. In a variant, the pyrotechnic charges 23 may be in the form of a granular material. Naturally, it is possible to have a single gas generator containing a first fraction of pyrotechnic charges that are in the form of monolithic blocks and a second fraction of pyrotechnic charges that are in the form of a granular material.

The pyrotechnic charges 23 used in the gas generator 20 of the extinguisher 1 may have the same composition as the pyrotechnic charges typically used in gas generators for airbags. Naturally, the pyrotechnic charges 23 present dimensions adapted to the intended operating duration (i.e. bigger than those of the pyrotechnic charges used in gas generators for airbags). Pyrotechnic compositions suitable for use in the gas generator of the extinguisher of the invention are described in particular in the following documents: U.S. Pat. Nos. 5,608,183, 6,143,102, FR 2 975 097, FR 2 964 656, FR 2 950 624, FR 2 915 746, FR 2 902 783, FR 2 899 227, FR 2 892 117, FR 2 891 822, FR 2 866 022, FR 2 772 370, and FR 2 714 374. By way of example, the gas generator may have at least five pyrotechnic charges 23, e.g. at least ten pyrotechnic charges, e.g. at least twenty pyrotechnic charges.

The extinguisher 1 also presents a discharge channel 12 configured to deliver the extinguishing agent to the outside of the extinguisher 1 when the pyrotechnic gas generator 20 is in action. In the example shown in FIG. 2, the channel 12 passes through the pressurizing chamber 5 and the perforated wall 7 and opens out directly in the storage chamber 4. Thus, the channel 12 opens out in the storage chamber 4 through an opening 12*a* situated in the perforated wall 7. Under such circumstances, the opening 12*a* is positioned at a zero distance from the perforated wall, and thus at a distance that is necessarily less than or equal to half the length of the storage chamber. The channel 12 also passes through the bottom end wall 2*b* of the body 2. The extinguisher 1 is configured to deliver the extinguishing agent when the pyrotechnic gas generator is actuated through an outlet orifice 10 situated in the bottom end wall 2*b* of the body. Thus, in the example shown in FIG. 2, the channel 12 presents a first end opening out into the storage chamber 4, which end is constituted by the opening 12*a*, and a second end opening out to the outside of the extinguisher 1, which opening is constituted by the outlet orifice 10. In the example shown, the channel 12 extends along the longitudinal axis X of the body. By way of example, the channel 12 may present a diameter D1 (i.e. its greatest transverse dimension) lying in the range 20 millimeters (mm) to 40 mm. In a variant that is not shown, it is possible for the outlet orifice to be present in the side wall of the body at the level of the pressurizing chamber and for said orifice to communicate in the same manner with the storage chamber via a channel passing through the pressurizing chamber and the perforated wall and opening out directly into the storage chamber.

The extinguisher 1 also has a first shutter 15 shutting the discharge channel 12 in sealed manner, the first shutter 15 being configured to enable the extinguishing agent to exit to the outside of the extinguisher 1 through the channel 12 when the pressure in the storage chamber 4 exceeds a predefined value. In other words, the first shutter 15 is configured, when in a first configuration, to prevent the extinguishing agent exiting to the outside to the outside of the extinguisher 1, and it is also configured to pass into a second configuration when the pressure in the storage chamber 4 exceeds a predefined value, this second configuration of the first shutter 15 allowing the extinguishing agent to exit to the outside of the extinguisher 1. By way of example, the first shutter 15 may be in the form of a diaphragm configured to yield when the pressure in the storage chamber 4 exceeds a predefined value. Under such circumstances, and by way of example, the first shutter 15 may be a diaphragm made of aluminum or of an alloy of the Inconel® type. In a variant, the first shutter 15 may be configured to move without yielding when the pressure in the storage chamber 4 exceeds a predefined value, thereby enabling the extinguishing agent to exit to the outside of the extinguisher through the discharge channel 12 and the outlet orifice 10. Under such circumstances, and by way of example, the first shutter 15 may be in the form of a valve, e.g. in the form of a spring-loaded valve. As mentioned above, the presence of the first shutter is advantageous for avoiding any need for a user to actuate delivery of the extinguishing agent to the outside of the extinguisher. This serves advantageously to optimize the flow of extinguishing agent delivered by the extinguisher.

It would not go beyond the ambit of the present invention for the extinguisher to have a plurality of discharge channels, with some or all of these channels not being provided with a first shutter as described above. Nor would it go beyond the ambit of the invention if the extinguisher does not have any such first shutter. Under such circumstances, the delivery of the extinguishing agent to the outside of the extinguisher is actuated by a user.

Figure 3:
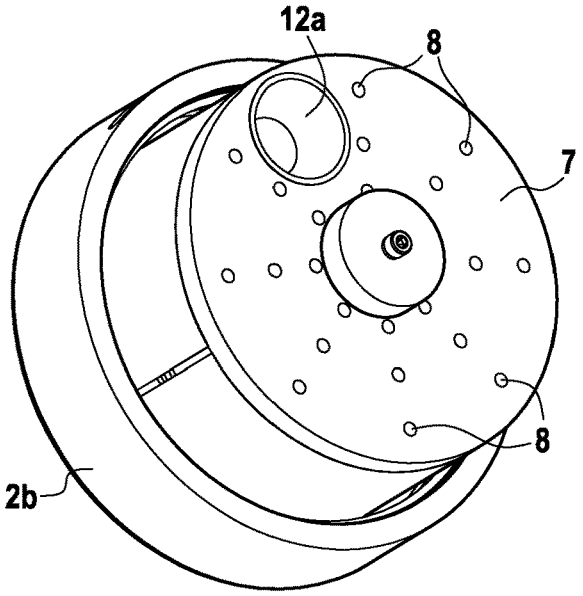
FIG. 3 shows a detail of the FIG. 1 extinguisher.

FIG. 3 shows the perforated wall 7 in greater detail. The perforated wall 7 separates the pyrotechnic gas generator from the extinguishing agent present in the storage chamber. The perforated wall 7 is configured to put an outlet of the pyrotechnic gas generator into communication with the storage chamber. As shown, and by way of example, the perforated wall 7 may be in the form of a plate having a plurality of perforations 8 configured to allow a combustion gas produced by the pyrotechnic gas generator to flow into the storage chamber. The perforated wall 7 presents a plurality of perforations 8 distributed around the longitudinal axis X of the body 2 of the extinguisher 1. In the example shown, the flow direction of the combustion gas through the perforated wall is substantially parallel to the longitudinal axis of the body. In an embodiment, the perforations 8 act as nozzles for the gas generator. The perforated wall 7 extends transversely, e.g. perpendicularly, relative to the longitudinal axis of the body.

Some or all of the perforations 8 in the perforated wall 7 may be shut in sealed manner prior to first use of the extinguisher 1 by means of a second shutter 30 that is configured, under the effect of the pressure of the combustion gas produced by the gas generator, to allow said gas to flow into the combustion chamber through the perforations. By way of example, the second shutter 30 may be in the form of a diaphragm that may be situated in the storage chamber and cover the perforated wall 7, or that may be situated in the pressurizing chamber. This diaphragm may be in contact with the perforated wall 7. By way of example, the diaphragm may be formed by a plastics material such as polyethylene terephthalate or such as an adhesive metal film such as a film of aluminum or of tin so as to operate in shear when subjected to pressure by the pyrotechnic gas generator. The diaphragm may advantageously be adhesively bonded on the perforated wall 7. The second shutter 30 may be suitable for yielding under the effect of the pressure of the combustion gas produced by the gas generator in order to allow said gas to flow into the storage chamber. The presence of the second shutter 30 is advantageous for isolating and protecting the gas generator, thereby preventing said generator being polluted by the extinguishing agent and giving better control over the ignition of the pyrotechnic charge(s). Naturally, it would not go beyond the ambit of the present invention for the extinguisher not to have such a second shutter 30.

Thus, and as shown in particular in FIGS. 1 to 3, the extinguisher 1 does not have a dip tube extending into the load of extinguishing agent for the purpose of transporting the extinguishing agent towards the outlet orifice. Likewise, the extinguisher 1 does not have a dip tube extending in the load of extinguishing agent and serving to transport the combustion gas produced by the gas generator into the load of extinguishing agent. Thus, the invention serves advantageously to provide extinguishers presenting a number of components that is reduced compared with the prior art and thus to have structures that are lighter in weight and less expensive, with efficiency that is at least equal.

The operation of the extinguisher 1 described with reference to FIGS. 1 to 3 is described below.

Figure 4:
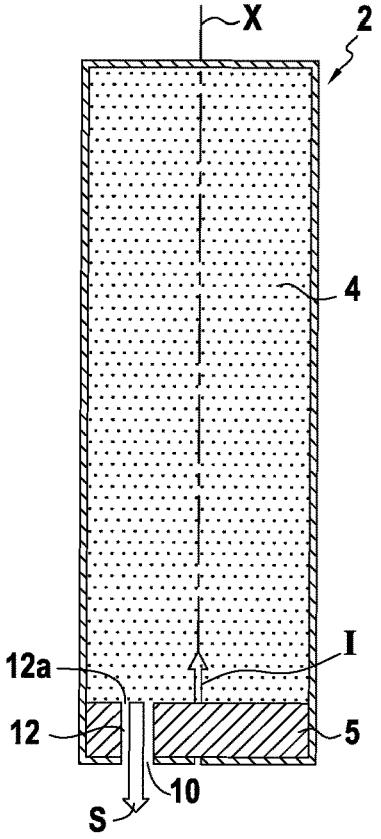
FIG. 4 shows the operation of the FIG. 1 extinguisher.

Actuating the pyrotechnic gas generator serves to cause one or more pyrotechnic charges to combustion and thereby generate combustion gas. Under the effect of the pressure of the combination gas the second shutter gives way so as to enable the combustion gas to flow through the perforated walls to the storage chamber and come into contact with the extinguishing agent. The combustion gas thus serves to put the storage chamber under pressure. In the storage chamber, the load of extinguishing agent may be in the form of a powder, as mentioned above. The powder may advantageously present apparent density lying in the range 40% to 55% of its theoretical density. When the combustion gas penetrates into the storage chamber, such values for the apparent density of the powder serve advantageously to create a fluidized bed that enhances delivery of the extinguishing agent to the outside of the extinguisher. Once a predefined value has been reached for the pressure in the storage chamber, the first shutter goes into a second configuration enabling the extinguishing agent to exit to the outside of the extinguisher through the discharge channel and the outlet orifice. The predefined pressure value in the storage chamber at which the first shutter goes into the second configuration may be greater than or equal to 20 bars, or even 40 bars. The time during which the extinguishing agent is discharged to the outside of the extinguisher may be greater than or equal to 1 second, or 5 seconds, or indeed 10 seconds, for example. In an advantageous variant, the gas generator continues to operate after the first shutter has gone into the second configuration. That serves advantageously to increase the fraction of the extinguishing agent that is discharged to the outside of the extinguisher. In a variant, the gas generator stops operating when the first shutter goes into the second configuration. As mentioned above, the arrangement shown serves advantageously to avoid the outlet orifice becoming blocked with the extinguishing agent, and thus enables a significant fraction of the extinguishing agent to be discharged to the outside of the extinguisher. In operation, the extinguisher may be horizontal or vertical, and for example it may be mounted in a vehicle. FIG. 4 shows in highly diagrammatic manner how the FIG. 1 extinguisher operates. Combustion gas penetrating into the storage chamber 4 is represented in FIG. 4 by arrow I, and the extinguishing agent exiting to the outside of the extinguisher 1 is represented by arrow S. In the example shown, the direction in which the combustion gas penetrates into the storage chamber and the direction in which the extinguishing agent exits to the outside of the extinguisher are both substantially parallel to the longitudinal axis X of the body 2.

Figure 5:
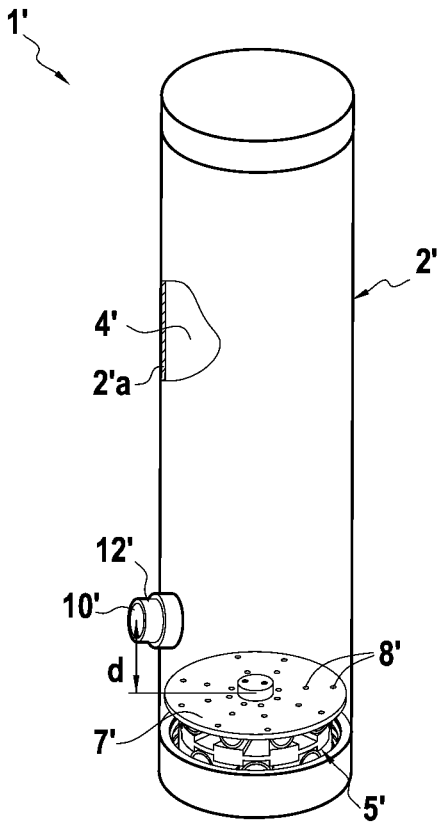
FIG. 5 shows another example of an extinguisher of the invention.
Figure 6:
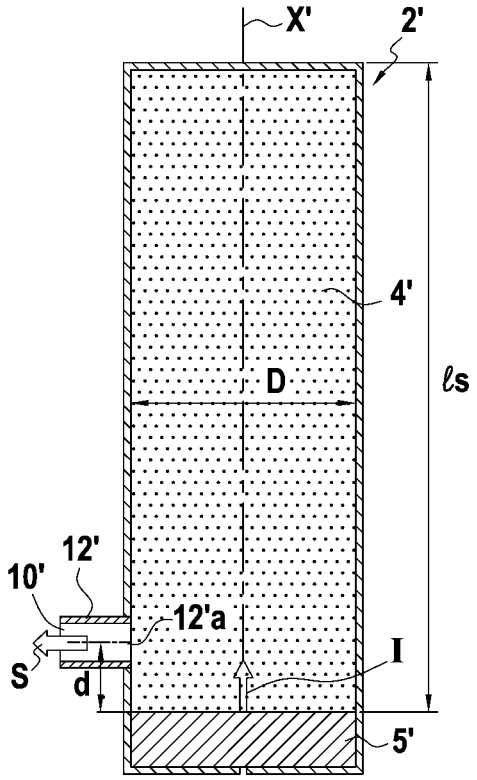
FIG. 6 shows the operation of the FIG. 5 extinguisher.

FIG. 5 shows a variant extinguisher 1' of the invention. In the same manner as for the extinguisher 1 shown in FIG. 1, the extinguisher 1' comprises a body 2' defining a storage chamber 4' in which a load of an extinguishing agent is present, and also a pressurizing chamber 5' containing a pyrotechnic gas generator. The pressurizing chamber 5' is separated from the storage chamber 4' by a perforated wall 7' configured to put an outlet from the pyrotechnic gas generator into communication with the storage chamber 4'. In the same manner as for the example of FIG. 1, the perforated wall 7' presents a plurality of perforations 8' distributed around the longitudinal axis X' of the body 2' of the extinguisher 1'. Unlike the example shown in FIG. 1, the discharge channel 12' passes through the side wall 2'*a* of the body. The discharge channel 12' opens out into the storage chamber 4' via an opening 12'*a* positioned at a distance d from the perforated wall 7' that is shorter than or equal to half the length $l_s$ of the storage chamber, or indeed one-fourth of this length, or even less, or else equal to the inside diameter D of the storage chamber. As shown in FIGS. 5 and 6, the distance d corresponds to the distance between the center of the opening 12'*a* and the perforated wall 7'. In the example shown in FIGS. 5 and 6, the channel 12' has a first end opening out into the storage chamber 4' constituted by the opening 12'*a*, and a second end opening out to the outside of the extinguisher 1 and constituted by the outlet orifice 10'. As in the embodiment of FIG. 1, the extinguisher 1' may optionally include a first shutter and/or a second shutter.

The operation of the extinguisher 1' shown in FIG. 5 is shown very diagrammatically in FIG. 6. Combustion gas penetrating into the storage chamber 4' is represented in FIG. 6 by arrow I, and the exit of the extinguishing agent to the outside of the extinguisher 1' is represented by arrow S. In the example shown, the combustion gas penetrates into the storage chamber in a direction that is substantially parallel to the longitudinal axis X' of the body 2', and the extinguishing agent exits in a direction S to the outside of the extinguisher that is substantially perpendicular to the longitudinal axis X' of the body 2'.

Figure 7:
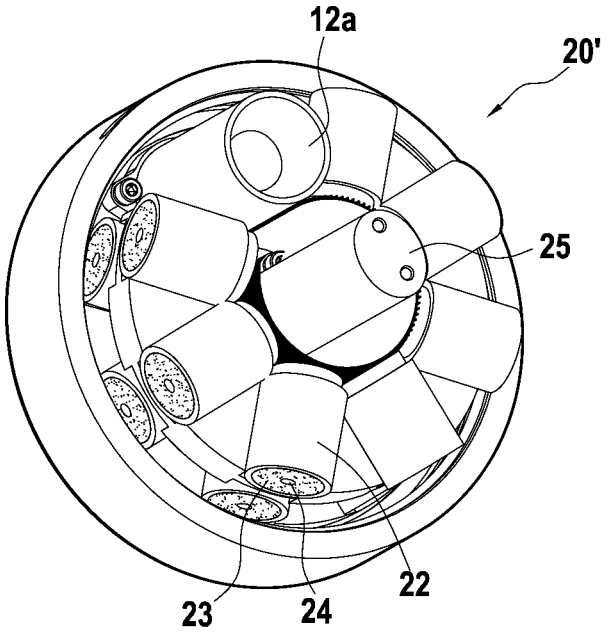
FIG. 7 shows a variant of the pyrotechnic gas generator usable in the example of FIG. 1.

FIG. 7 shows a variant pyrotechnic gas generator 20' suitable for use in the example of FIG. 1. The gas generator 20' comprises a plurality of housings 22, each containing a pyrotechnic charge 23, the housings 22 being positioned around the longitudinal axis of the body of the extinguisher. As shown, the housings 22 extend radially (perpendicularly relative to the longitudinal axis of the body). The example shown in FIG. 7 comprises a first group of housings superposed on a second group of housings, the housings of the first group being present at a first height in the body and the housings of the second group being present at a second height in the body that is different from the first height. Naturally, it would not go beyond the ambit of the invention for the pyrotechnic gas generator to have a single group of housings positioned around the longitudinal axis of the body of the extinguisher, said housings all being present at the same height in the body. In the example of FIG. 7, the housings 22 are positioned around the igniter device 25 configured to ignite the pyrotechnic charges 23 present in said housings. The igniter device 25 presents radial orifices, each orifice being situated facing a pyrotechnic charge 23. As shown in FIG. 7, the igniter device 25 is present in a central portion of the pyrotechnic gas generator 20'. In addition, as shown in FIG. 7, some or all of the pyrotechnic charges 23 may present an open channel 24. Each channel 24 opens out at two opposite ends of a pyrotechnic charge 23. The presence of such a channel passing through the pyrotechnic charge serves advantageously to control the rate at which gas is generated during combustion of said pyrotechnic charge, and possibly even to make this rate constant. The gas generator 20' shown in FIG. 7 advantageously presents a structure that is relatively compact occupying little space. Naturally, it is possible in a variant to avoid having a channel 12 present and to incorporate a pyrotechnic gas generator of the same type as in the extinguisher in the example shown in FIG. 5.

The term "lying in the range . . . to . . . " should be understood as including the bounds.

The invention claimed is:

1. A fire extinguisher comprising:

a body extending along a longitudinal axis and defining a storage chamber wherein a load of an extinguishing agent is stored, the storage chamber having an upper surface defining a top end of the storage chamber, and a lower surface defining a bottom end of the storage chamber, the upper surface and lower surface being positioned at opposite ends of the storage chamber along the longitudinal axis;

a pressurizing chamber including a pyrotechnic gas generator;

a perforated wall that separates the pressurizing chamber from the storage chamber, the perforated wall is configured to put an outlet of the pyrotechnic gas generator into communication with the storage chamber, the perforated wall being the lower surface that defines the bottom end of the storage chamber at a longitudinal end of the storage chamber; and a discharge channel configured to deliver the extinguishing agent to the outside of the extinguisher during actuation of the pyrotechnic gas generator, wherein said discharge channel opens out into the storage chamber through an opening positioned at a distance from the perforated wall, as measured along the longitudinal axis of the body, that is less than or equal to half the length of the storage chamber.

2. The extinguisher according to claim 1, further comprising a first shutter shutting the discharge channel in sealed manner, said first shutter being configured to enable the extinguishing agent to exit to the outside of the extinguisher through the discharge channel when the pressure in the storage chamber exceeds a predefined value.

3. The extinguisher according to claim 1, wherein the perforated wall includes at least one perforation and the extinguisher also includes a second shutter shutting said at least one perforation in sealed manner, said second shutter being configured to act, under the effect of the pressure of a combustion gas produced by the gas generator, to enable said gas to flow into the storage chamber through said at least one perforation.

4. The extinguisher according to claim 1, wherein the discharge channel passes through the pressurizing chamber and the opening is situated in the perforated wall.

5. The extinguisher according to claim 4, wherein the pressurizing chamber is situated between the perforated wall and an end wall of the body, the discharge channel also passing through the end wall.

6. The extinguisher according to claim 1, wherein the opening is situated in a side wall of the body.

7. The extinguisher according to claim 1, wherein the distance (d) between the opening and the perforated wall is less than or equal to one-fourth of the length (□s) of the storage chamber.

8. The extinguisher according to claim 1, wherein the distance (d) between the opening and the perforated wall is less than or equal to the inside diameter of the storage chamber.

9. The extinguisher according to claim 1, wherein the ratio (length of the storage chamber)/(inside diameter of the storage chamber) is less than or equal to 10.

10. The extinguisher according to claim 1, wherein the perforated wall presents a plurality of perforations distributed around the longitudinal axis of the extinguisher.

11. The extinguisher according to claim 1, wherein the extinguishing agent is in powder form.

12. The extinguisher according to claim 1, wherein the gas generator includes at least one housing containing a pyrotechnic charge, said pyrotechnic charge presenting a through channel.

13. The extinguisher according to claim 1, wherein the gas generator includes a plurality of housings, each containing a pyrotechnic charge, said housings being positioned around the longitudinal axis of the body.

14. The extinguisher according to claim 13, wherein the housings are positioned around an igniter device configured to ignite the pyrotechnic charges present in said housings.

15. A vehicle fitted with an extinguisher according to claim 1.

* * * * *